US005787985A

United States Patent [19]

Oneal et al.

[11] Patent Number: 5,787,985

[45] Date of Patent: Aug. 4, 1998

[54] PROPPANT CONTAINMENT APPARATUS AND METHODS OF USING SAME

[75] Inventors: Dean S. Oneal, Lafayette, La.; Ralph H. Echols, Dallas, Tex.

[73] Assignee: Halliburton Energy Services, Inc., Dallas, Tex.

[21] Appl. No.: 587,352

[22] Filed: Jan. 16, 1996

[51] Int. Cl.[6] ..... E21B 43/04; E21B 43/08

[52] U.S. Cl. ..... 166/278; 166/51; 166/205

[58] Field of Search ..... 166/278, 51, 205, 166/157, 233

[56] References Cited

U.S. PATENT DOCUMENTS

| | | | |
|---|---|---|---|
| Re. 14,756 | 11/1919 | Scott | 166/205 |
| 2,646,752 | 7/1953 | Slater | 166/205 |
| 3,425,490 | 2/1969 | Clayton | 166/205 |
| 3,515,210 | 6/1970 | Perkins | 166/205 |
| 4,083,660 | 4/1978 | Newbrough | 166/106 |
| 4,286,659 | 9/1981 | Bolding, Jr. | 166/205 |
| 4,627,488 | 12/1986 | Szarka | 166/51 |
| 4,722,392 | 2/1988 | Proctor et al. | 166/217 |
| 4,840,229 | 6/1989 | Proctor et al. | 166/381 |
| 5,062,484 | 11/1991 | Schroeder, Jr. et al. | 166/278 |
| 5,090,478 | 2/1992 | Summers | 166/278 |
| 5,330,003 | 7/1994 | Bullick | 166/278 |
| 5,335,727 | 8/1994 | Cornette et al. | 166/278 |
| 5,443,117 | 8/1995 | Ross | 166/51 |
| 5,515,915 | 5/1996 | Jones et al. | 166/51 |

*Primary Examiner*—Hoang C. Dang

*Attorney, Agent, or Firm*—William M. Imwalle; Paul I. Herman; Marlin R. Smith

[57] ABSTRACT

A proppant containment apparatus and associated method of using the apparatus permit continued delivery of a proppant slurry to a subterranean wellbore after failure of a crossover portion of the apparatus during a fracturing operation, eliminating the need to stop the fracturing operation and remove and replace expensive items of equipment after such crossover failure. In a preferred embodiment, the proppant containment apparatus has a tubular crossover member with an internal flow passage, circulation port, and side wall outlet openings, first and second coaxial tubular structures, the first tubular structure being perforated, a tubular screen positioned between the first and second tubular structures, a ball, and a ball seat having a spaced series of grooves formed thereon.

30 Claims, 3 Drawing Sheets

PROPPANT CONTAINMENT APPARATUS AND METHODS OF USING SAME

BACKGROUND OF THE INVENTION

The present invention relates generally to tools used in subterranean wells and, in a preferred embodiment thereof, more particularly provides a proppant containment apparatus for use in formation fracturing operations.

Oftentimes, a potentially productive geological formation beneath the earth's surface contains a sufficient volume of valuable fluids, such as hydrocarbons, but also has a very low permeability. "Permeability" is a term used to describe that quality of a geological formation which enables fluids to move about in the formation. All potentially productive formations have pores, a quality described using the term "porosity", within which the valuable fluids are contained. If, however, the pores are not interconnected, the fluids cannot move about and, thus, cannot be brought to the earth's surface.

When such a formation having very low permeability, but a sufficient quantity of valuable fluids in its pores, is desired to be produced, it becomes necessary to artificially increase the formation's permeability. In some situations, the low permeability of the formation may only exist near the wellbore (e.g., when the low permeability was caused by drilling muds and completion fluids), in which case it is only necessary to artificially increase the formation's permeability near the wellbore. In either case, this is typically accomplished by "fracturing" the formation, a practice which is well known in the art and for which purpose many methods have been conceived. Basically, fracturing is achieved by applying sufficient pressure to the formation to cause the formation to crack or fracture, hence the name. The desired result being that the cracks interconnect the formation's pores and allow the valuable fluids to be brought out of the formation and to the surface.

A conventional method of fracturing a formation begins with drilling a subterranean well into the formation and cementing a protective tubular casing within the well. The casing is then perforated to provide fluid communication between the formation and the interior of the casing which extends to the surface. A packer is set in the casing to isolate the formation from the rest of the wellbore, and hydraulic pressure is applied to the formation via tubing which extends from the packer to pumps on the surface.

The pumps apply the hydraulic pressure by pumping fracturing fluid down the tubing, through the packer, through a service tool assembly, into the wellbore below the packer, through the perforations, and finally, into the formation. The pressure is increased until the desired quality and quantity of cracks is achieved. Much research has gone into discerning the precise amount and rate of fracturing fluid and hydraulic pressure to apply to the formation to achieve the desired quality and quantity of cracks.

The fracturing fluid's composition is far from a simple matter itself. Modern fracturing fluids may include sophisticated manmade proppants suspended in gels. "Proppant" is the term used to describe material in the fracturing fluid which enters the formation cracks once formed and while the hydraulic pressure is still being applied (that is, while the cracks are still being held open by the hydraulic pressure), and acts to prop the cracks open. When the hydraulic pressure is removed, the proppant keeps the cracks from closing completely. The proppant thus helps to maintain the artificial permeability of the formation after the fracturing job is over. Fracturing fluid containing suspended proppant is also called a slurry.

A proppant may be nothing more than a very fine sand, or it may be a particulate material specifically engineered for the job of holding formation cracks open. Whatever its composition, the proppant must be very hard and strong to withstand the forces trying to close the formation cracks. These qualities also make the proppant a very good abrasive. It is not uncommon for holes to be formed in the protective casing, tubing, pumps, and any other equipment through which a slurry is pumped.

Particularly susceptible to abrasion wear from pumped slurry is any piece of equipment in which the slurry must make a sudden or significant change in direction. The slurry, being governed by the laws of physics, including the principles of inertia, tends to maintain its velocity and direction of flow, and resists any change thereof. An object in the flowpath of the slurry which tends to change the velocity or direction of the slurry's flow will soon be worn away as the proppant in the slurry incessantly impinges upon the object.

Of particular concern in this regard is a piece of equipment attached to the tubing extending below the packer which takes the slurry as it is pumped down the tubing and redirects it radially outward so that it exits the tubing and enters the formation through the perforations. That piece of equipment is known to those skilled in the art as a crossover. Assuming, for purposes of convenience, that the tubing extends vertically through the wellbore, and that the formation is generally horizontal, the crossover must change the direction of the slurry by ninety degrees. Because of this significant change of direction, few pieces of equipment (with the notable exception of the pumps) must withstand as much potential abrasive wear as the crossover.

In addition, the crossover is frequently called upon to do several other tasks while the slurry is being pumped through it. For example, the crossover typically contains longitudinal circulation ports through which fracturing fluids that are not received into the formation after exiting the crossover are transmitted back to the surface. Space limitations in the wellbore dictate that the circulation ports are not far removed from the flowpath of the slurry through the crossover. If the crossover is worn away such that the slurry flowpath achieves fluid communication with the circulation ports in the crossover, the fracturing job must cease while the tubing is removed from the wellbore to replace the crossover at great loss of time and money. Otherwise, the slurry will enter the circulation ports in the crossover and the proppant will fill the tubing below the crossover, any screens attached thereto, and possibly stick the tool in the well. This latter situation is usually the result of a failed crossover, since operators at the earth's surface do not usually know that the crossover has been worn away.

For the above reasons and others, the crossover has commonly been considered a critical piece of equipment, whose failure during slurry delivery usually means failure of the entire fracturing job. Extensive measures have been employed in the past to avoid failure of the crossover, that is, to retard abrasive wear of the crossover and the resultant communication between the slurry flowpath and circulation ports. None, however, have solved the problem of how to continue a fracturing job even after the crossover has failed.

From the foregoing, it can be seen that it would be quite desirable to provide a proppant containment apparatus which permits a fracturing job to continue following the failure of the crossover. It is accordingly an object of the present invention to provide such a proppant containment apparatus and associated methods of using same.

SUMMARY OF THE INVENTION

In carrying out the principles of the present invention, in accordance with a preferred embodiment thereof, a proppant containment apparatus and method of using same are provided, which apparatus and method are specially adapted for utilization in formation fracturing operations in subterranean wellbores. The apparatus prevents proppant from entering other wellbore equipment if, for example, a crossover portion of the apparatus fails by erosion due to an abrasive slurry being forced through it.

In broad terms, a proppant containment apparatus is provided which includes first and second tubular members, each of the first and second tubular members having first and second opposite ends, the first tubular member second opposite end being coaxially attached to the second tubular member first opposite end, the second tubular member having first and second internal surfaces and the first tubular member having a third internal surface, the first internal surface being adjacent the second tubular member first opposite end and the first tubular member second opposite end, and the first internal surface being radially outwardly disposed relative to each of the second and third internal surfaces, and a screen disposed within the second tubular member radially inward relative to the first internal surface, the screen having an outer peripheral edge portion, the outer peripheral edge portion being disposed radially outward relative to each of the second and third internal surfaces, such that the screen is retained axially intermediate the second and third internal surfaces.

A proppant containment apparatus operatively positionable in a subterranean wellbore is also provided, the apparatus including a perforated pipe having an axially extending internal flow passage, an external side surface, first and second opposite ends, and an opening formed on an axial portion of the perforated pipe, the internal flow passage being closed at the first opposite end and open at the second opposite end, a screen radially outwardly overlying the opening, the screen being attached to the perforated pipe external side surface intermediate the perforated pipe first and second opposite ends, a generally tubular structure having an internal side surface, the tubular structure radially outwardly overlying the perforated pipe, an annular flow passage formed radially intermediate the perforated pipe external side surface and the tubular structure internal side surface, the screen being disposed in the annular flow passage, and an annular seal member disposed in the annular flow passage and sealingly engaging the perforated pipe external side surface and the tubular structure internal side surface, the opening being disposed axially intermediate the perforated pipe closed end and the annular seal member.

Also provided is an apparatus operatively positionable in a subterranean wellbore for containing particles delivered to the wellbore in a slurry, the apparatus including a first tubular member having first and second opposite ends, and an internal coaxial flow passage formed therein through which the slurry may be flowed, the internal flow passage extending from the first opposite end to the second opposite end, a screen disposed in the first tubular member internal flow passage, the screen being capable of filtering the particles from the slurry, a seal structure attached to the first tubular member second opposite end, the seal structure having a seal surface disposed therein, the seal surface being in fluid communication with the internal flow passage and having an indentation formed thereon, and a seal member disposed intermediate the screen and the seal surface, the seal member being biased to sealingly engage the seal surface when the slurry flows from the screen to the seal structure.

For use in conjunction with an abrasive slurry delivery structure having a first tubular structure with an internal flow passage through which an abrasive slurry may be axially flowed, a side wall outlet opening bounded by a peripheral side wall edge portion and outwardly through which abrasive slurry material from the internal flow passage may be discharged, and an internal circulation passage formed adjacent the peripheral side wall edge portion, a method of containing abrasive particles in the internal circulation passage after slurry erosion of the peripheral side wall edge portion is provided, the method including the steps of providing a second tubular structure having first and second opposite ends, and an internal flow passage formed therein through which the slurry may be flowed, attaching the second tubular structure first opposite end to the first tubular structure such that the internal circulation passage is in fluid communication with the second tubular structure internal flow passage, providing a screen capable of filtering the abrasive particles from the slurry, and disposing the screen in the second tubular structure internal flow passage.

A method of containing proppant delivered to a subterranean wellbore in a slurry is also provided, the method including the steps of providing a first tubular structure having a first internal flow passage through which the slurry may be flowed, an axial portion having a sidewall section with an outlet slot disposed therein and through which the slurry may be outwardly discharged from the internal flow passage, the outlet slot being circumscribed by a peripheral edge portion of the side wall section, and an axially elongated circulation port formed in the side wall section, providing a second tubular structure, coaxially mounting the second tubular structure to the first tubular structure radially outward from the circulation port and extending axially outward from the first tubular structure, providing a screen capable of filtering the proppant from the slurry, mounting the screen in the second tubular structure, providing a radially inwardly sloping surface, mounting the inwardly sloping surface to the second tubular member, providing a ball capable of sealingly engaging the sloping surface, and disposing the ball axially intermediate the sloping surface and the screen.

The disclosed slurry proppant containment apparatus and method of using same permit fracturing operations to be performed more economically and with less damage to equipment disposed within a wellbore.

DETAILED DESCRIPTION

Figure 1A:
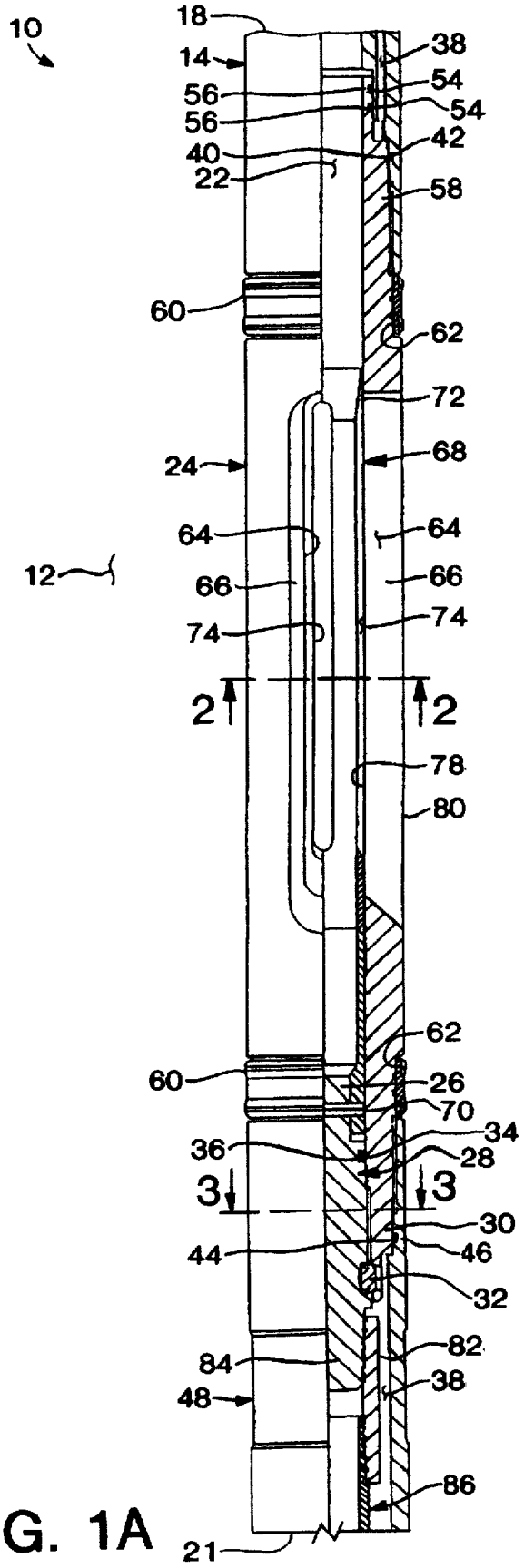
FIGS. 1A–1B are quarter sectioned views of a proppant containment apparatus embodying principles of the present invention.
Figure 1B:
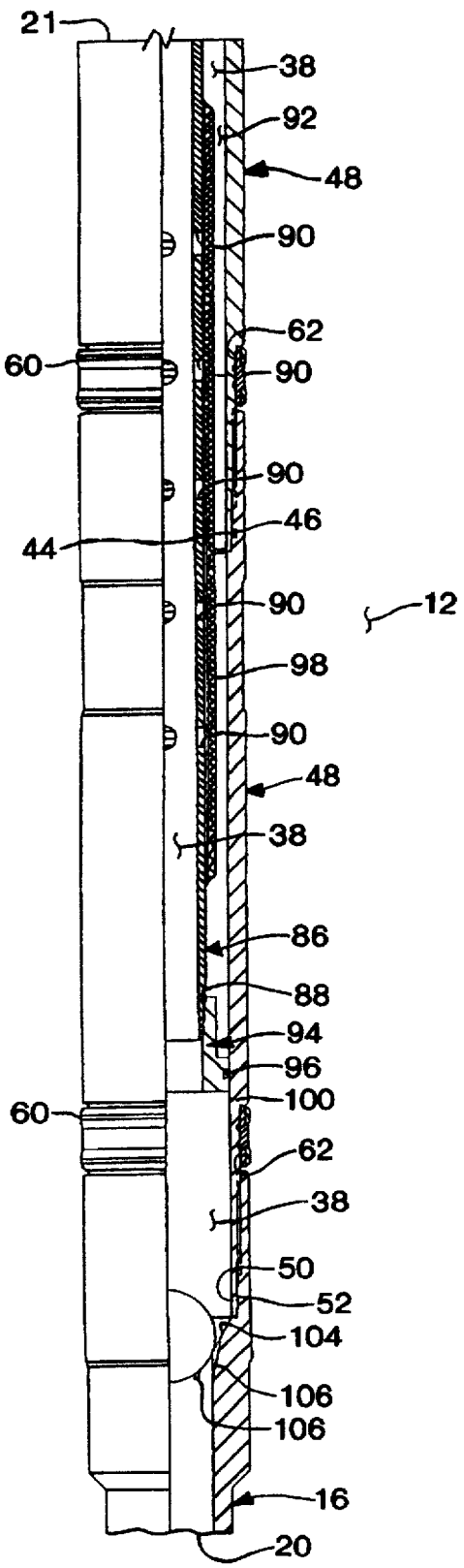

Illustrated in FIGS. 1A and 1B is a proppant containment apparatus 10 which embodies principles of the present invention. In the following detailed description of the apparatus 10 representatively illustrated in FIGS. 1A and 1B, and subsequent figures described hereinbelow, directional terms such as "upper", "lower", "upward", "downward", etc. will be used in relation to the apparatus 10 as it is depicted in the accompanying figures. It is to be understood that the apparatus 10 may be utilized in vertical, horizontal, inverted, or inclined orientations without deviating from the principles of the present invention.

Apparatus 10, as representatively illustrated in FIGS. 1A and 1B, is specially adapted for use within a tool string known to those skilled in the art as a service tool string (not shown), which is suspended from tubing extending to the earth's surface, the tubing being longitudinally disposed within protective casing in a subterranean wellbore 12. In FIGS. 1A and 1B, the wellbore 12 is external to the apparatus 10. The service tool string is typically inserted through a packer (not shown) during a fracturing job. A pressurized, abrasive slurry is then pumped through the tubing and into the service tool string. Tubular upper connector 14 and lower connector 16 permit interconnection of the apparatus 10 into the service tool string. Accordingly, upper portion 18 of upper connector 14 is connected to the service tool string above the apparatus 10, and lower portion 20 of lower connector 16 is connected to the remainder of the service tool string extending below the apparatus 10. Note that illustratively cut surface 21 of FIG. 1A is continuous with the same cut surface 21 of FIG. 1B.

Axial flow passage 22 extends longitudinally (i.e., axially) downward from the upper portion 18 of upper connector 14, axially through the upper connector, and into a generally tubular crossover 24. The axial flow passage 22 terminates at upper radially reduced portion 26 of generally cylindrical plug 28. Plug 28 is threadedly installed into lower portion 30 of crossover 24 and secured with a pair of set screws 32 (only one of which is visible in FIG. 1A). Sealing engagement between the plug 28 and the lower portion 30 of crossover 24 is provided by seal 34 disposed in circumferential groove 36 externally formed on the plug.

Radially displaced, longitudinally extending, circulation flow passage 38 extends downwardly from upper portion 18, through the upper connector 14, longitudinally through the crossover 24 in a manner that will be described more fully hereinbelow, through the lower connector 16, and to lower portion 20. When operatively installed in the wellbore 12, the circulation flow passage 38 in the apparatus 10 is sealingly isolated from the wellbore 12 external to the apparatus by seal 40 disposed in circumferential groove 42 internally formed on the upper connector 14, by seals 44 disposed in circumferential grooves 46 internally formed on extension subs 48, and by seal 50 disposed in circumferential groove 52 internally formed on the lower connector 16. The circulation flow passage 38 is sealingly isolated from axial flow passage 22 in the apparatus 10 by seal 34, and by a pair of seals 54, each disposed in one of a pair of circumferential grooves 56 externally formed on an upper portion 58 of the crossover 24 which is threadedly installed coaxially into the upper connector 14.

In operation, the proppant slurry is pumped downwardly through the longitudinal flow passage 22, radially outward through the crossover 24 and into the wellbore 12, and outwardly into the geological formation being fractured and/or gravel packed (not shown). The fluid portion of the proppant slurry (minus the proppant) which is not retained in the formation is returned to the earth's surface through the circulation flow passage 38. Thus, the normal direction of flow in the circulation flow passage 38 is longitudinally upward as viewed in FIGS. 1A and 1B, with no proppant in the flow.

Annular seal rings 60 are disposed in longitudinally spaced apart external annular recesses 62 formed between upper connector 14 and upper portion 58 of crossover 24, between lower portion 30 of crossover 24 and the representatively illustrated upper extension sub 48, between the extension subs 48, and between the representatively illustrated lower extension sub 48 and lower connector 16. The seal rings 60 seal the apparatus 10 within the packer and other equipment into which the apparatus 10 may be longitudinally disposed.

Four longitudinally extending circumferentially spaced apart slotted outlet openings or exit ports 64 (three of which are visible in FIG. 1A), having external radially extending and circumferentially sloping surfaces 66 formed thereon, provide fluid communication between the axial flow passage 22 and the wellbore 12. It is through these exit ports 64 that a slurry must pass in its transition from longitudinal flow in the axial flow passage 22 to radial flow into the wellbore 12. Because of the substantial change of direction from longitudinal flow to radial flow of the slurry through the exit ports 64, the exit ports are particularly susceptible to abrasion wear from proppant contained in the slurry.

In order to protect the exit ports 64 against abrasion wear, a tubular protective sleeve 68 is coaxially disposed within the crossover 24. The protective sleeve 68 is made of a suitably hard and tough abrasion resistant material, such as tungsten carbide, or is made of a material, such as alloy steel, which has been hardened. If made of an alloy steel, the protective sleeve 68 is preferably through-hardened by a process such as nitriding. The protective sleeve 68 is secured into the crossover 24 by drive pin 70 which extends laterally through the protective sleeve and the upper portion 26 of the plug 28.

Upper portion 72 of protective sleeve 68 extends axially upward past the exit ports 64 in the crossover 24, thereby completely internally overlapping the portion of the crossover 24 in which the exit ports 64 are located. Four circumferentially spaced and longitudinally extending slotted ports 74 are formed radially through the sleeve 68 and are aligned with the exit ports 64 in the crossover 24. The ports 74 in the sleeve 68, however, are smaller in length and width than the ports 64 in the crossover 24, such that the sleeve 68 completely internally overlaps the crossover 24 in the exit ports 64 area of the crossover.

Figure 2:
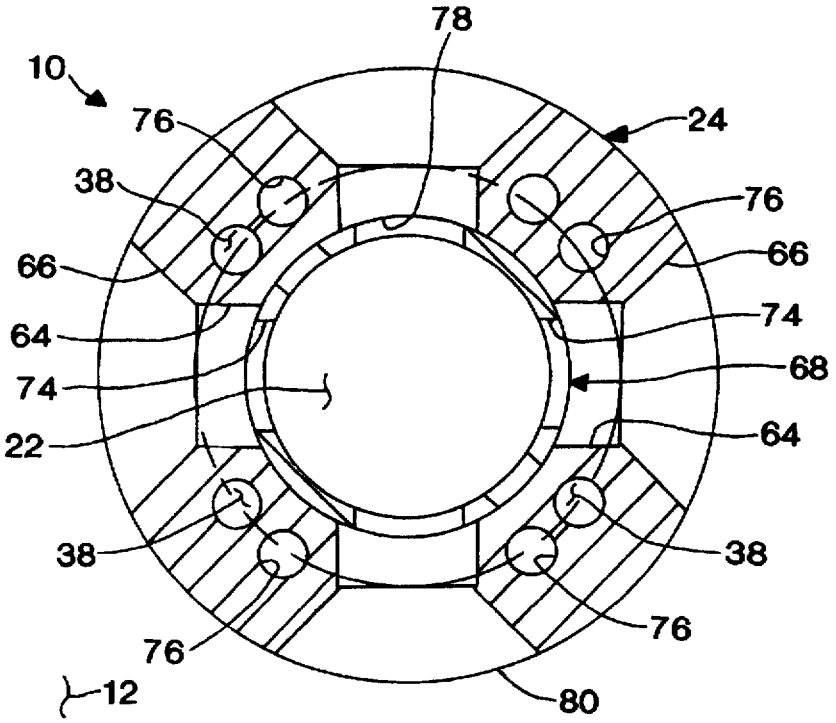
FIG. 2 is an enlarged scale cross-sectional view of a crossover of the proppant containment apparatus, taken along line 2—2 of FIG. 1A.

Referring additionally now to FIG. 2, a cross-sectional view may be seen of the apparatus 10 representatively illustrated in FIG. 1A. The cross-section is taken through line 2—2 of FIG. 1A which extends laterally through the crossover 24. In this view, the manner in which circulation flow passage 38 extends longitudinally through the crossover 24 may be seen.

Eight longitudinally extending and circumferentially spaced circulation ports 76 are disposed radially intermediate inner diameter 78 of the crossover 24 and outer diameter 80 of the crossover. Two each of the circulation ports 76 are disposed in the crossover 24 circumferentially intermediate each pair of exit ports 64. Flow ports 74 in protective sleeve 68, being somewhat smaller in width than the exit ports 64, act to protect the exit ports 64 from abrasion wear due to radially outwardly directed flow of the slurry. It may be clearly seen in FIG. 2 that if exit ports 64 wear appreciably circumferentially outward, or if the protective sleeve 68 and inner diameter 78 of the crossover 24 wear appreciably radially outward, the exit ports 64 and flow passage 22 will eventually be in fluid communication with the circulation ports 76. If such abrasive wear of the crossover 24 does occur, the proppant slurry will be permitted to enter the circulation ports 76.

Figure 3:
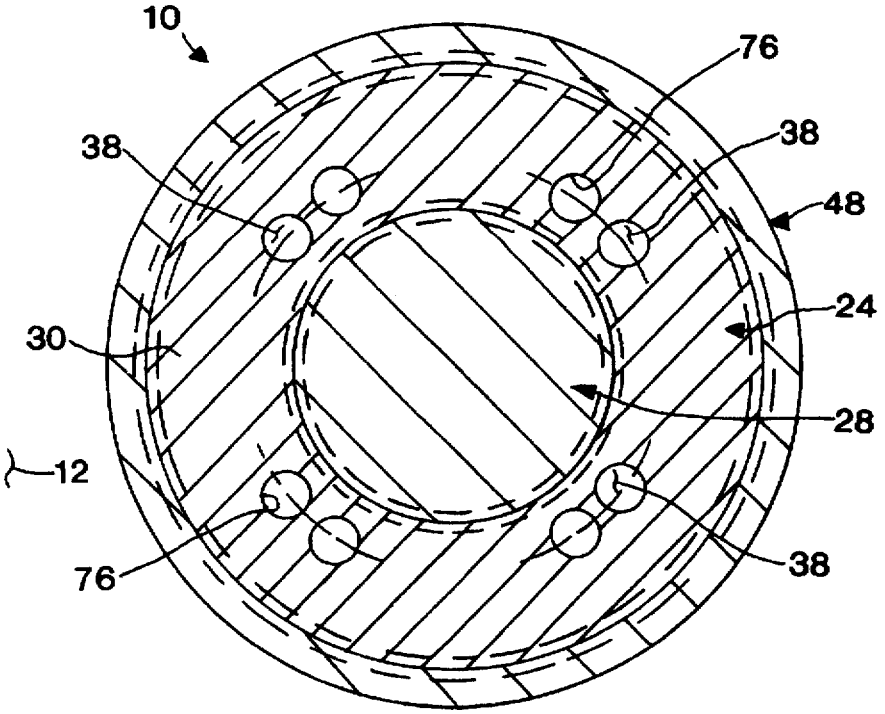
FIG. 3 is an enlarged scale cross-sectional view of the proppant containment apparatus, taken along line 3—3 of FIG. 1A.

Referring additionally now to FIG. 3, a cross-sectional view of the apparatus 10, taken laterally along line 3—3 of FIG. 1A may be seen. FIG. 3 further illustrates the manner in which the circulation ports 76 extend longitudinally through the crossover 24. It may thus be clearly seen that circulation ports 76 provide fluid communication for the circulation flow passage 38 from the upper connector 14 to the lower portion 30 of the crossover 24. Consequently, if the proppant slurry enters the circulation ports 76 adjacent the crossover exit ports 64 as above described, the proppant slurry will be permitted to enter the circulation flow passage 38 in the extension subs 48 and lower connector 16.

The circulation flow passage 38 in the lower connector 16 is in fluid communication with various equipment (not shown) installed in the wellbore 12 below the apparatus 10. In a fracturing and/or gravel pack job, this equipment may include equipment known to those skilled in the art as washpipes and sand control screens. It is critical in such jobs that the washpipes and sand control screens not be filled with proppant, else they will have to be removed from the well, cleaned, and replaced at great expense.

If the proppant slurry enters the circulation flow passage 38 in the lower connector 16 and is permitted to flow into the equipment, the job must be stopped immediately (if that fact is known to the operator at the earth's surface), before the equipment fills with proppant. To allow the job to be continued even though the proppant slurry has broken through to the circulation flow passage 38 in the crossover 24, apparatus 10 includes specially designed features which prevent passage of the proppant into the circulation flow passage 38 in the lower connector 16, while still permitting circulation flow from the lower connector 16 to the upper connector 14 as normal.

Referring specifically now to FIGS. 1A and 1B, a coupling 82 is threadedly and sealingly attached to the plug 28 at a lower portion 84 of the plug. Coupling 82 is also threadedly and sealingly attached to a longitudinally extending perforated pipe 86 which is coaxially disposed within extension subs 48. As representatively illustrated in FIGS. 1A and 1B, the perforated pipe 86 is contained within two extension subs 48, but it is to be understood that a different number of extension subs 48 may be utilized and the perforated pipe 86 may be longer or shorter without departing from the principles of the present invention. For applications normally encountered in oilwell fracturing and/or gravel packing jobs, applicants prefer utilizing extension subs 48 having a combined overall length of approximately eight to twelve feet and perforated pipe 86 having an overall length of approximately six to ten feet. Perforated pipe 86 may be extended by threadedly attaching another coupling 82 to a lower end 88 of the perforated pipe 86 and attaching another perforated pipe to the additional coupling 82. For illustrative clarity, however, only one perforated pipe 86 is shown in FIGS. 1A and 1B.

Perforated pipe 86 includes a series of longitudinally spaced apart openings 90 extending radially therethrough. Openings 90 permit fluid communication between the circulation flow passage 38 in an annular area 92 formed between the perforated pipe 86 and extension subs 48, and the circulation flow passage 38 within the lower connector 16. Although openings 90 are representatively illustrated in FIG. 1B as being circular and longitudinally aligned, it is to be understood that openings 90 may also have other shapes, for example, slotted, and may be longitudinally and circumferentially staggered or otherwise positioned on the perforated pipe 86 without departing from the principles of the present invention.

The circulation flow passage 38 in the annular area 92 between the perforated pipe 86 and the extension subs 48 is separated from the circulation flow passage 38 in the lower connector 16 by an annular ring 94 threadedly and sealingly installed onto the lower end 88 of the perforated pipe 86 and coaxially disposed within the lower extension sub 48. A seal 96 sealingly engages the annular ring 94 and the lower extension sub 48. Thus, any flow in the circulation flow passage 38 which is forced longitudinally downward through the annular area 92 must pass through the openings 90 in the perforated pipe 86 before entering the circulation flow passage 38 in the lower connector 16.

Radially outwardly overlying the perforated pipe 86 is a generally tubular screen 98. The screen 98 has openings therethrough which do not permit proppant to pass through the screen. Applicants prefer that the screen 98 have openings of approximately 0.006–0.008 inch, although other screen openings may be utilized without departing from the principles of the present invention. The screen 98 may be made of materials such as wrapped wire, sintered metal, or any other material suitable for screening proppant from the proppant slurry. Additionally, the screen 98 may be integrally formed with the perforated pipe 86, for example, the openings 90 may be very narrow slots. Applicants prefer a tubular welded sand screen for screen 98.

Screen 98 is representatively illustrated in FIG. 1B as being welded at each of its opposite ends to the perforated pipe 86, longitudinally and radially outwardly overlying the openings 90 in the perforated pipe. Thus, any flow in the circulation flow passage 38 which passes from the annular area 92 to the lower connector 16 through the openings 90 must first pass through the screen 98. It is to be understood that methods of sealingly attaching the screen 98 to the perforated pipe 86 other than welding may be utilized without departing from the principles of the present invention.

Downwardly directed flow in the circulation flow passage 38, which has passed through the screen 98 and perforated pipe 86, next enters lower portion 100 of the lower extension sub 48. A ball 102 is contained within the lower portion 100 of the extension sub 48 between the annular ring 94 and a radially inwardly tapered surface 104 formed internally within the lower connector 16. Downwardly directed flow in the circulation flow passage 38 tends to bias the ball 102 against the surface 104. When biased against the surface 104, the ball 102 is sealingly engaged by the surface 104, except where circumferentially spaced and radially inclined grooves 106 have been formed in the lower connector 16. Grooves 106 permit a small amount of flow in the circulation flow passage 38 downwardly past the ball 102 to the lower portion 20 of the lower connector 16. Upwardly directed flow in the circulation flow passage 38 (i.e., the "normal" flow direction in the circulation flow passage when there is no fluid communication between the proppant slurry in the exit ports 64 and the circulation flow ports 76 in the crossover 24 as described above) may pass from the lower portion 20 of the lower connector 16 to the perforated pipe 86 virtually unimpeded by the ball 102, since upwardly directed flow tends to lift the ball 102 off of the surface 104.

Thus has been described the proppant containment apparatus 10 which permits a fracturing job to continue even after the crossover 24 has been abraded such that the proppant slurry enters the circulation flow ports 76. Use of the above described apparatus 10 prevents proppant from filling equipment below the crossover 24, such as wash pipe and sand control screens, and helps to prevent sticking of the service tool and wash pipe in the well. Failure of the crossover 24 will, using the apparatus 10, result in filling the annular area 92 with proppant, but the job will be capable of being continued. Note, also, that in case of failure of the screen 98, the ball 102, due to its restriction of downwardly directed flow, will prevent substantial quantities of proppant from reaching the lower end 20 of the lower connector 16, as the proppant will tend to quickly pack off and close the grooves 106.

An additional benefit obtained from use of the proppant containment apparatus 10 is filtering of the normally upwardly directed flow in the circulation flow passage 38. As described above, upwardly directed flow in the circulation flow passage 38 usually does not contain any proppant, it usually is only the fluid portion of the proppant slurry. If, however, proppant or foreign matter does enter the upwardly directed flow in circulation flow passage 38, it will not be able to pass through the screen 98. Screening proppant or foreign matter from upwardly directed flow in the circulation flow passage 38 aids in reducing wear of the seals 60 by preventing proppant from flowing between the service tool and the packer and being deposited between the service tool and the casing above the packer. Combined with other benefits, this helps permit the apparatus 10 to do more than one fracturing job without replacing the seals 60.

Figure 4A:
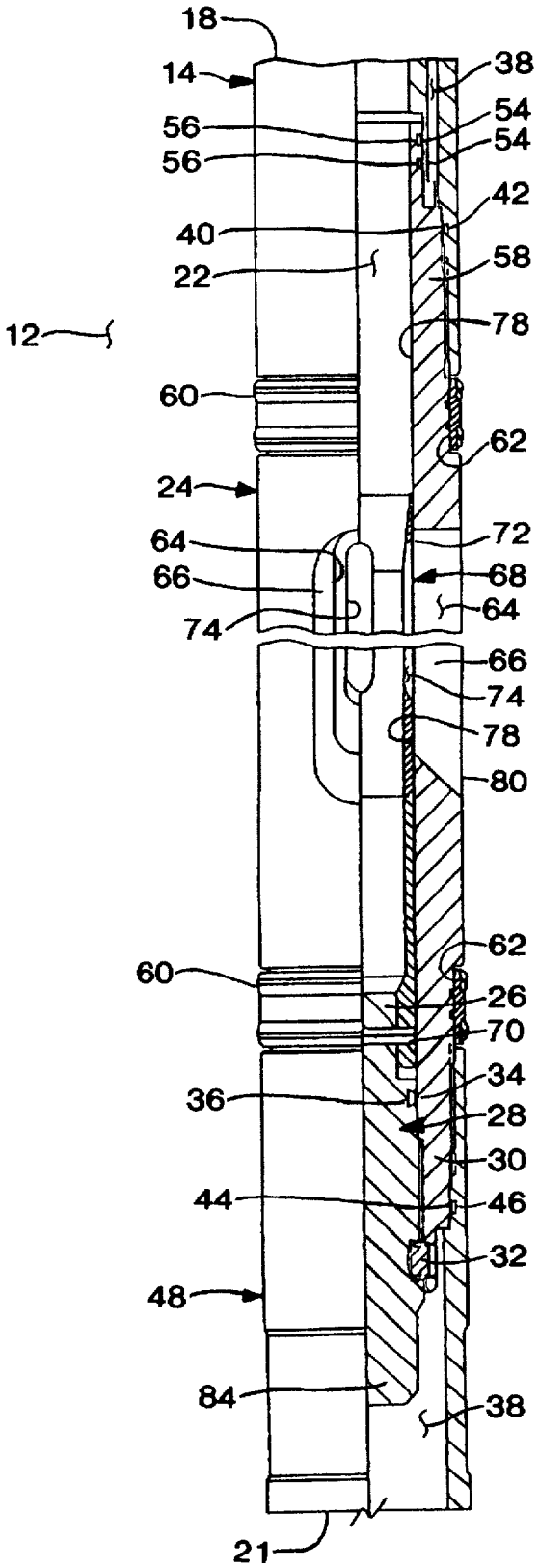
FIGS. 4A–4B are quarter sectioned views of another proppant containment apparatus embodying principles of the present invention.
Figure 4B:
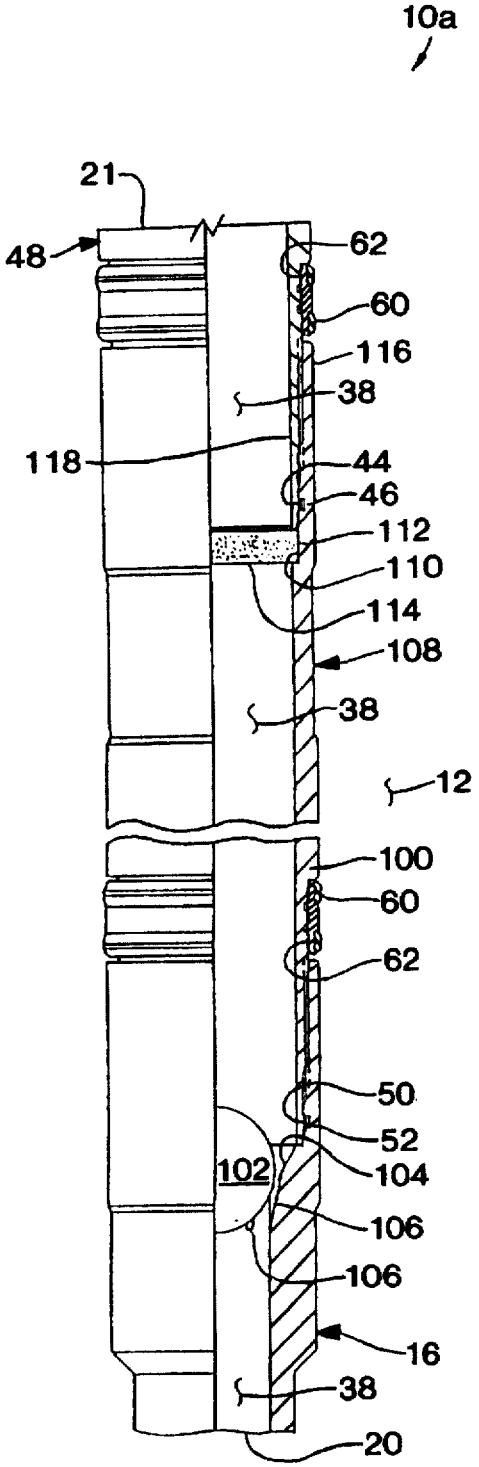

Illustrated in FIGS. 4A and 4B is another embodiment 10*a* of the proppant containment apparatus 10. For convenience, elements of the apparatus 10a representatively illustrated in FIGS. 4A and 4B which are substantially similar to those elements illustrated in the foregoing described figures are identified with the same item numbers as previously used.

Note that in the apparatus 10*a* as shown in FIGS. 4A and 4B, plug 28 does not have a coupling 82 attached to its lower end 84, or a perforated pipe 86 and screen 98 disposed in the extension sub 48. The embodiment of the apparatus 10*a* shown in FIGS. 4A and 4B differs in one respect from the embodiment 10 shown in FIGS. 1A and 1B in the method utilized to screen the proppant from downwardly directed flow in the circulation flow passage 38.

In the representatively illustrated embodiment 10*a* of the apparatus 10 in FIGS. 4A and 4B, an extension sub 108 has a longitudinally extended inner diameter 110 formed therein. The inner diameter 110 defines an internal annular pocket 112 between extension sub 48 and extension sub 108. A flat circular screen 114 is laterally disposed in the annular pocket 112.

The flat circular screen 114 may be made of sintered metal or any other material capable of screening the proppant. Applicants prefer sintered metal for the flat screen 114 material because of its ability to withstand relatively high flow rates (approximately 1–5 barrels per minute) without breaking down or collapsing. Note that the portion of the flat screen 114 which extends laterally across the flow passage 38 is supported only at its edges in the annular pocket 112. Thickness of the flat screen 114 is preferably approximately 1 inch for a preferred diameter of approximately 2.25 inches. Larger diameter flat screens 114 or higher flow rates will typically require greater thicknesses or supporting gussets, etc. for sufficient rigidity. It is to be understood that various shapes and dimensions of the screen 114 may be utilized without departing from the principles of the present invention.

Extension sub 108 is threadingly attached to extension sub 48 by tightening upper end 116 of extension sub 108 onto lower end 118 of extension sub 48. Screen 114 is partially compressed in the annular pocket 112 before upper end 116 contacts the seal ring 60 disposed between the extension subs 48 and 108. In this manner, screen 114 is sealingly engaged at its outer edge in the annular pocket 112 between lower end 118 and upper end 116 when extension sub 108 is attached to extension sub 48.

Downwardly directed flow in the circulation flow passage 38 must pass through the screen 114 in order to flow from within extension sub 48 to within extension sub 108. Therefore, proppant will be contained within extension sub 48 and will not pass into extension sub 108. If the screen 114 should collapse or otherwise fail, the ball 102 will prevent substantial quantities of proppant from entering the circulation flow passage 38 below the ball 102 as described above. The ball 102 will not, however, prevent all sand from entering the circulation flow passage 38 below the ball.

The foregoing detailed description is to be clearly understood as being given by way of illustration and example only, the spirit and scope of the present invention being limited solely by the appended claims.

What is claimed is:

1. Propant containment apparatus operatively positionable in a subterranean well, comprising:

a perforated pipe having an axially extending internal flow passage, an external side surface, first and second opposite ends, and an opening formed on an axial portion of said perforated pipe, said internal flow passage being closed at said first opposite end and open at said second opposite end;

a screen radially outwardly overlying said opening, said screen being attached to said perforated pipe external side surface intermediate said perforated pipe first and second opposite ends;

a generally tubular structure having an internal side surface, said tubular structure radially outwardly overlying said perforated pipe;

an annular flow Passage formed radially intermediate said perforated pipe external side surface and said tubular structure internal side surface, said screen being disposed in said annular flow passage;

an annular seal member disposed in said annular flow passage and sealingly engaging said perforated pipe external side surface and said tubular structure internal side surface, said opening being disposed axially intermediate said perforated pipe closed end and said annular seal member;

a ball sealing surface attached to said tubular structure; and a ball disposed axially intermediate said perforated pipe second opposite end and said ball sealing surface, said ball being capable of sealingly engaging said ball sealing surface.

2. The apparatus according to claim 1, further comprising a fluid passage formed across said ball sealing surface, said fluid passage permitting fluid communication across said ball sealing surface when said ball sealingly engages said ball sealing surface.

3. Proppant containment apparatus operatively positionable in a subterranean well, comprising:

a perforated nine having an axially extending internal flow passage, an external side surface, first and second opposite ends, and an opening formed on an axial portion of said perforated pipe, said internal flow passage being closed at said first opposite end and open at said second opposite end;

a screen radially outwardly overlying said opening, said screen being attached to said perforated pipe external side surface intermediate said perforated pipe first and second opposite ends;

a generally tubular structure having an internal side surface, said tubular structure radially outwardly overlying said perforated pipe;

an annular flow passage formed radially intermediate said perforated pipe external side surface and said tubular structure internal side surface, said screen being disposed in said annular flow passage;

an annular seal member disposed in said annular flow passage and sealingly engaging said perforated pipe external side surface and said tubular structure internal side surface, said opening being disposed axially intermediate said perforated pipe closed end and said annular seal member; and a crossover attached to said perforated pipe and said tubular structure, said crossover having formed therein an axially extending circulation port, an axially extending slurry passage, and a radially outwardly directed slurry port, said slurry passage and said slurry port being in fluid communication with each other, and said circulation port being in fluid communication with said annular flow passage adjacent said perforated pipe first opposite end.

4. Apparatus operatively positionable in a subterranean wellbore for containing particles delivered to the wellbore in a slurry, comprising:

a first tubular member having first and second opposite ends, and an internal coaxial flow passage formed therein through which the slurry may be flowed, said internal flow passage extending from said first opposite end to said second opposite end;

a screen disposed in said first tubular member internal flow passage, said screen being capable of filtering the particles from the slurry;

a seal structure attached to said first tubular member second opposite end, said seal structure having a seal surface disposed therein, said seal surface being in fluid communication with said internal flow passage and having an indentation formed thereon; and a seal member disposed intermediate said screen and said seal surface, said seal member being biased to sealingly engage said seal surface when the slurry flows from said screen to said seal structure.

5. The apparatus according to claim 4, wherein said indentation prevents a pressure differential being formed across said seal member when the slurry biases said seal member to sealingly engage said seal surface.

6. The apparatus according to claim 4, further comprising a second tubular member coaxially attached to, and extending outwardly from, said first tubular member first opposite end, said second tubular member having an internal flow passage formed therein which is in fluid communication with said first tubular member internal flow passage, and said screen being disposed intermediate said first tubular member internal flow passage and said second tubular member internal flow passage.

7. The apparatus according to claim 6, wherein said screen is compressed between said first tubular member and said second tubular member when said first tubular member is attached to said second tubular member.

8. The apparatus according to claim 4, further comprising a second tubular member disposed within said first tubular member, said second tubular member having a plurality of radial perforations formed thereon and an internal flow passage, said first tubular member internal flow passage being in fluid communication with said second tubular member internal flow passage through said perforations, and said screen being disposed intermediate said perforations and said first tubular member internal flow passage.

9. Apparatus operatively positionable in a subterranean wellbore during pressurized proppant slurry delivery into the wellbore, comprising:

a first tubular structure having a first internal flow passage through which the proppant slurry may be axially flowed in a downstream direction, an axial portion having a sidewall section with a circumferentially spaced plurality of axially elongated first outlet slots disposed therein and through which the proppant slurry may be outwardly discharged from said internal flow passage, each of said first outlet slots being circumscribed by a peripheral edge portion of said side wall section, and a circumferentially spaced plurality of axially elongated circulation ports formed in said side wall section intermediate said first outlet slots and through which the proppant slurry may be axially flowed in an upstream direction;

a second tubular structure coaxially mounted to said first tubular structure radially outwardly from said circulation ports and extending outwardly from said first tubular structure in said downstream direction;

a third tubular structure coaxially disposed within said second tubular structure and defining an annular gap between said second tubular structure and said third tubular structure, said third tubular structure having an inner side surface, a plurality of openings formed radially therethrough, said openings permitting fluid communication between said annular gap and said inner side surface, and opposite open and closed ends, said closed end being mounted to said first tubular structure radially inwardly from said circulation ports, such that said circulation ports are in fluid communication with said annular gap;

a seal member sealing off said annular gap between said second and third tubular structures;

a fourth tubular structure capable of filtering the proppant slurry, said fourth tubular structure being coaxially disposed within said annular gap axially intermediate said first tubular structure and said seal member and radially outwardly adjacent said third tubular structure openings;

a radially inwardly sloping surface mounted to said second tubular structure and being disposed axially outwardly from said seal member, said sloping surface having an axially extending groove formed internally thereon; and a ball disposed axially intermediate said seal member and said sloping surface, said ball being capable of sealingly engaging said sloping surface.

10. The apparatus according to claim 9, wherein said fourth tubular structure has first and second opposite ends, said third tubular structure openings being disposed axially intermediate said fourth tubular structure first and second opposite ends.

11. The apparatus according to claim 10, wherein each of said fourth tubular structure first and second opposite ends are circumferentially sealed to an outer side surface of said third tubular structure.

12. The apparatus according to claim 9, wherein said groove permits fluid communication across said sloping surface when said ball sealingly engages said sloping surface.

13. The apparatus according to claim 12, further comprising a fifth tubular structure attached to said second tubular structure, said fifth tubular structure having said sloping surface formed therein and an axially extending second internal flow passage, said sloping surface being intermediate said second internal flow passage and said seal member, and said second internal flow passage being in fluid communication with said circulation ports in said first tubular structure.

14. For use in conjunction with an abrasive slurry delivery structure having a first tubular structure with an internal flow passage through which an abrasive slurry may be axially flowed, a side wall outlet opening bounded by a peripheral side wall edge portion and outwardly through which abrasive slurry material from the internal flow passage may be discharged, and an internal circulation passage formed adjacent the peripheral side wall edge portion, a method of containing abrasive particles in the internal circulation passage after slurry erosion of the peripheral side wall edge portion, the method comprising the steps of:

providing a second tubular structure having first and second opposite ends, and an internal flow passage formed therein through which the slurry may be flowed;

attaching said second tubular structure first opposite end to said first tubular structure such that the internal circulation passage is in fluid communication with said second tubular structure internal flow passage;

providing a screen capable of filtering the abrasive particles from the slurry; and disposing said screen in said second tubular structure internal flow passage.

15. The method according to claim 14, further comprising the steps of:

providing a seal structure having a seal surface disposed therein;

attaching said seal structure to said second tubular structure second opposite end such that said seal surface is in fluid communication with said second tubular structure internal flow passage;

providing a seal member capable of sealingly engaging said seal surface; and disposing said seal member in said second tubular structure internal flow passage intermediate said screen and said seal surface such that slurry flow from said screen to said seal member biases said seal member to sealingly engage said seal surface.

16. The method according to claim 15, further comprising the step of forming a fluid passage on said seal surface such that fluid communication remains across said seal surface when said seal member is biased to sealingly engage said seal surface.

17. The method according to claim 14, further comprising the steps of:

providing a third tubular structure having an internal flow passage formed therein;

disposing said screen intermediate said third tubular structure internal flow passage and said second tubular structure internal flow passage;

attaching said third tubular structure intermediate said first tubular structure and said second tubular structure such that said third tubular structure internal flow passage is in fluid communication with the internal circulation passage and said second tubular structure internal flow passage; and compressing said screen between said second and third tubular structures.

18. The method according to claim 17, wherein said screen providing step further comprises providing said screen made of a sintered metal material.

19. The method according to claim 14, further comprising the steps of:

providing a third tubular structure having a perforated axial portion and an internal flow passage formed therein;

disposing said third tubular structure in said second tubular structure internal flow passage such that said second tubular structure internal flow passage is in fluid communication with said third tubular structure internal flow passage through said perforated axial portion; and disposing said screen adjacent said perforated axial portion and intermediate said second tubular structure internal flow passage and said third tubular structure internal flow passage.

20. The method according to claim 19, wherein said screen providing step further comprises providing a tubular welded sand screen.

21. A method of containing proppant delivered to a subterranean wellbore in a slurry, the method comprising the steps of:

providing a first tubular structure having a first internal flow passage through which the slurry may be flowed, an axial portion having a sidewall section with an outlet slot disposed therein and through which the slurry may be outwardly discharged from said internal flow passage, said outlet slot being circumscribed by a peripheral edge portion of said side wall section, and an axially elongated circulation port formed in said side wall section;

providing a second tubular structure;

coaxially mounting said second tubular structure to said first tubular structure radially outward from said circulation port and extending axially outward from said first tubular structure;

providing a screen capable of filtering the proppant from the slurry;

mounting said screen in said second tubular structure;

providing a radially inwardly sloping surface;

mounting said inwardly sloping surface to said second tubular structure;

providing a ball capable of sealingly engaging said sloping surface; and disposing said ball axially intermediate said sloping surface and said screen.

22. The method according to claim 21, further comprising the steps of:

providing a third tubular structure having an inner side surface, a plurality of openings formed radially therethrough, and opposite open and closed ends;

coaxially disposing said third tubular structure within said second tubular structure and defining an annular gap between said second tubular structure and said third tubular structure, said closed end being mounted to said first tubular structure radially inwardly from said circulation ports, such that said circulation ports are in fluid communication with said annular gap;

providing a seal member;

sealing off said annular gap between said second and third tubular structures with said seal member, and wherein said screen providing step comprises providing a fourth tubular structure having first and second opposite ends, and wherein said screen mounting step comprises coaxially disposing said fourth tubular structure within said annular gap axially intermediate said first tubular structure and said seal member and radially outwardly adjacent said third tubular structure openings, such that said third tubular structure openings are disposed axially intermediate said fourth tubular structure first and second opposite ends.

23. The method according to claim 22, further comprising the step of circumferentially sealing each of said fourth tubular structure first and second opposite ends to an outer side surface of said third tubular structure.

24. The method according to claim 21, further comprising the step of forming a groove on said sloping surface to permit fluid communication across said sloping surface when said ball sealingly engages said sloping surface.

25. The method according to claim 21, further comprising the steps of:

providing a third tubular structure having an internal flow passage formed therein;

coaxially attaching said third tubular structure intermediate said first and second tubular structures such that said third tubular structure internal flow passage is in fluid communication with said circulation port and an internal flow passage of said second tubular structure, and wherein said screen mounting step comprises disposing said screen intermediate said second tubular structure internal flow passage and said third tubular structure internal flow passage.

26. A method of containing abrasive particles in a subterranean wellbore during pressurized particle slurry delivery into the wellbore, the method comprising the steps of:

providing a first tubular structure having a first internal flow passage through which the particle slurry may be axially flowed in a downstream direction, an axial portion having a sidewall section with a circumferentially spaced plurality of axially elongated first outlet slots disposed therein and through which the particle slurry may be outwardly discharged from said internal flow passage, each of said first outlet slots being circumscribed by a peripheral edge portion of said side wall section, and a circumferentially spaced plurality of axially elongated circulation ports formed in said side wall section intermediate said first outlet slots and through which the particle slurry may be axially flowed in an upstream direction;

providing a plug having an exterior surface;

mounting said plug to said first tubular structure downstream of said axial portion, such that said exterior surface of said plug is disposed radially inwardly from said circulation ports, and such that said plug defines a closed end portion of said first internal flow passage of said first tubular structure;

providing a second tubular structure;

coaxially mounting said second tubular structure to said first tubular structure radially outward from said circulation ports and extending axially outward from said first tubular structure in said downstream direction;

providing a third tubular structure having an inner side surface, a plurality of openings formed radially therethrough, and opposite open and closed ends;

mounting said closed end to said first tubular structure radially inward from said circulation ports;

coaxially disposing said third tubular structure within said second tubular structure and defining an annular gap between said second tubular structure and said third tubular structure, such that said openings permit fluid communication between said annular gap and said inner side surface, and such that said circulation ports are in fluid communication with said annular gap;

providing a seal member;

disposing said seal member in said annular gap and sealing off said annular gap between said second and third tubular structures;

providing a fourth tubular structure capable of filtering the particles from the slurry;

coaxially disposing said fourth tubular structure within said annular gap axially intermediate said first tubular structure and said seal member and radially outwardly adjacent said third tubular structure openings;

providing a radially inwardly sloping surface having an axially extending groove formed internally thereon;

mounting said sloping surface to said second tubular structure and disposing said sloping surface axially outward from said seal member;

providing a ball capable of sealingly engaging said sloping surface; and disposing said ball axially intermediate said seal member and said sloping surface.

27. The method according to claim 26, wherein said fourth tubular structure providing step further comprises providing said fourth tubular structure having first and second opposite ends, and wherein said fourth tubular structure disposing step further comprises disposing said fourth tubular structure such that said third tubular structure openings are disposed axially intermediate said fourth tubular structure first and second opposite ends.

28. The method according to claim 27, further comprising the step of circumferentially sealing each of said fourth tubular structure first and second opposite ends to an outer side surface of said third tubular structure.

29. The method according to claim 26, further comprising the step of permitting fluid communication through said groove and across said sloping surface when said ball sealingly engages said sloping surface.

30. The method according to claim 29, further comprising the steps of:

providing a fifth tubular structure having said sloping surface formed therein and an axially extending second internal flow passage; and attaching said fifth tubular structure to said second tubular structure, such that said second internal flow passage is in fluid communication with said circulation ports in said first tubular structure, said sloping surface is intermediate said second internal flow passage and said third tubular structure, and said ball is intermediate said sloping surface and said third tubular structure.

* * * * *